175-40
2/1/83 XR 4,370,886

United States Patent [19]

Smith, Jr. et al.

[11] 4,370,886

[45] Feb. 1, 1983

[54] IN SITU MEASUREMENT OF GAS CONTENT IN FORMATION FLUID

[75] Inventors: Harry D. Smith, Jr., Houston; Carl Dodge, Alief, both of Tex.

[73] Assignee: Halliburton Company, Duncan, Okla.

[21] Appl. No.: 248,162

[22] Filed: Mar. 30, 1981

[51] Int. Cl.[3] ..... E21B 49/00

[52] U.S. Cl. ..... 73/153; 73/19; 73/154; 175/40

[58] Field of Search ..... 73/153, 154, 19, 155; 175/40

[56] References Cited

U.S. PATENT DOCUMENTS

| | | | |
|---|---|---|---|
| 3,673,864 | 7/1972 | Cubberly, Jr. | 73/153 |
| 3,731,530 | 5/1973 | Tanguy et al. | 73/153 |
| 3,813,935 | 6/1974 | Tanguy et al. | 73/153 |
| 3,937,060 | 2/1976 | Lewis et al. | 73/153 |
| 4,319,482 | 3/1982 | Bunner | 73/153 |

*Primary Examiner*—Howard A. Birmiel
*Attorney, Agent, or Firm*—William J. Beard

[57] ABSTRACT

In situ measurement of the gas content of formation fluid using thermal expansion principles. The formation fluid from a wellbore source is passed through an expansion type valve into a test chamber. The temperature and pressure are measured upstream and downstream of the valve. The difference in the temperature measurement is an indicator of gas content in the formation fluid. Samples of the formation fluid can be taken on favorable indicators.

18 Claims, 3 Drawing Figures

FIG. 1
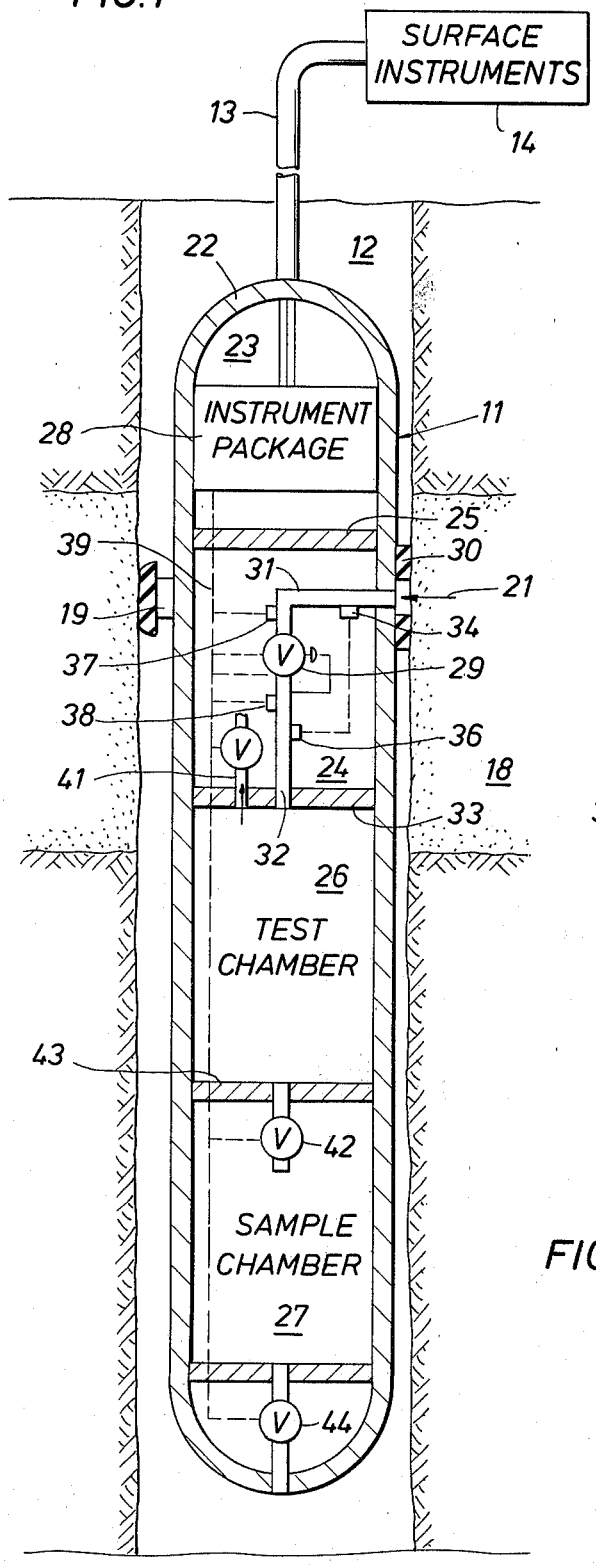
FIG. 2
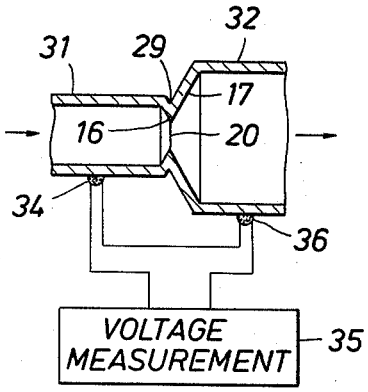
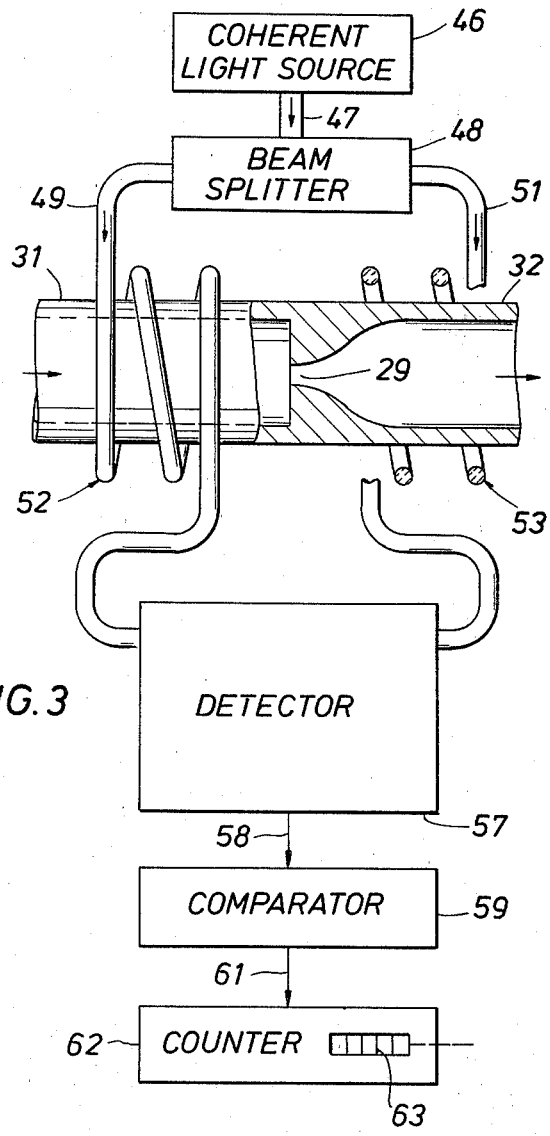
FIG. 3

IN SITU MEASUREMENT OF GAS CONTENT IN FORMATION FLUID

BACKGROUND OF THE INVENTION

This invention relates to measuring and testing systems, and more particularly, it relates to the measurement and sampling downhole in an oil well of the gas content in formation fluids.

It has been a common practice to evaluate the productivity of an oil well by using downhole wireline instruments. These instruments have varied from most complex to the very elementary types. Some formation testing instruments are capable of measuring many downhole parameters, e.g., temperature, pressure, flow rates, conductivity, etc., and sending the resulting information to the surface equipment for recording and evaluation. If this data were favorable of petroleum prospects, a sampling tool was then used to take a sample of the formation fluid.

The sample taking tools are simply a body with valving to allow an internal chamber to be filled with formation fluid. The tool then was raised to the surface and the formation fluid subjected to analysis for petroleum values.

The problem with these prior formation testing and sampling tools concerns the determination of taking a sample only when the formation fluid has petroleum values and not solely water. The particularly measured qualities in the petroleum containing formation fluid are the gas and oil contents.

The gas content in the formation fluid from a downhole producing formation is very vital information in making a commercial evaluation of petroleum production. It is especially important that this information be obtained quickly, and in a manner compatible with computer processing techniques so that the measurements are made in real time.

A formation pressure test can be made in a wellbore by opening a small chamber to be filled by formation fluid. Pressure sensors can measure the formation fluid pressure in the wellbore and also in the chamber. However, these pressure measurements provide no definitive information of the formation fluid character since high pressures can exist in gas, oil and water producing formations.

An expansion-type valve can be placed at the inlet to the chamber so that formation fluids containing gas at elevated pressures will produce a temperature reduction in their flow through the valve and into the reduced pressure environment of the chamber. Naturally, formation fluid without a gas content produces no significant temperature change in flowing through the expansion-type valve.

The present invention uses in combination, the above discussed pressure and temperature measurements and functions of these variables, as an indicator of the gas content of formation fluids so that an immediate determination can be made to take a sample of hydrocarbon bearing formation fluids.

SUMMARY OF THE INVENTION

In accordance with this invention, there is provided a system in method and apparatus for the in situ measurement of the gas content in formation fluid. A test chamber is positioned in a wellbore in proximity to a source of the formation fluid. The formation fluid is passed through an expansion-type valve into the test chamber.

Measurements are made of pressures and temperatures, upstream and downstream of the valve. The difference in the temperature measurements or their functions (e.g., the log of the difference in temperatures) is an indicator of gas content in the formation fluid.

In the preferred embodiment, the difference in the temperature measurements is correlated to the difference in pressure measurements as an indicator of gas content. When the indicator is favorable a sample is taken of the formation fluid for further analysis at the surface.

DESCRIPTION OF THE DRAWINGS

FIG. 1 is a perspective, partially in section, illustrating a downhole wireline tool using the present invention to determine the gas content of formation fluid;

FIG. 2 is a diagram illustrating a thermocouple system for making temperature measurements across an expansion valve in the wireline tool; and FIG. 3 is a graphic display of a fiber optic interferometer that also can be used to make temperature measurements in the wireline tool.

DESCRIPTION OF PREFERRED EMBODIMENT

Referring to FIG. 1, the wireline tool 11 is shown suspended in an uncased or open wellbore 12 by a cable 13 that is also used to transmit power and signals from the tool to a surface disposed information handling system 14. The surface system 14 can be conventional in function but preferably, it includes computer processing and control capabilities relative to the tool 11. The wellbore 12 exposes the surrounding formations, which formations include the prospective producing strata 18. The formation fluid at high pressure can flow from this source to the tool 11 as is shown by the arrow 21.

The cable 13 passes by a fluid-tight connection through the outer shell 22 of the tool 11. The shell isolates the internal chambers 23, 24, 26 and 27 from the wellbore 12. These chambers are isolated fluid-tight from each other by several dividing imperforate partitions 25, 33 and 43.

The chamber 23 contains an instrument package 28 that interconnects the various operative components in the tool 11 with the conductors of cable 13 for both control and signal transmission functions. The instrument package 28 can be of conventional design.

The chamber 24 contains an expansion type valve 29 which has an inlet pipe 31 extending through the shell 22 to accept flow of the formation fluid entering the wellbore 12 from strata 18. A resilient seal member 30 is forced against the strata 18 by a back-up arm 19 to insure the direct transfer of formation fluid into inlet pipe 31. An outlet pipe 32 extends from the valve 29 through the adjacent partition 33 into the test chamber 26. The test chamber is at reduced pressure relative to the inflowing formation fluid and therefore, there is a pressure difference and can be a temperature difference created across the valve 29.

The valve 29 may be a back-pressure controlled valve as shown in FIG. 1 so that a constant pressure drop exists across it irrespective of the actual pressure of the incoming formation fluid. However, the valve 29 is preferably a fixed orifice valve as is illustrated in FIGS. 2 and 3. These valve types function with a given pressure drop across them to make measurements for the purposes of this invention.

The temperatures upstream and downstream of the valve 29 are determined by transducers 34 and 36 mounted on pipes 31 and 32, respectively. The pressures upstream and downstream of the valve 29 are determined by transducers 37 and 38 mounted inside the pipes 31 and 32, respectively. The signals from these several transducers are sent by a signal bus 39 (illustrated by chain lines) to the instrument package 28. It can be recognized that it may be advisable to locate the temperature sensors closer to the valve than the pressure sensors.

These signals 39 are processed in the instrument package 28, as by a microprocessor, so that the difference in the temperature measurements by sensors 34 and 36 for a certain difference in the pressure measurements can be compared to a set of calibrated conditions stored in a memory lookup table.

It will be apparent that the measured magnitude in temperature difference is related both to the gas content of the formation fluid and the measured magnitude of the pressure change in the fluid flow across the valve 29. This relationship can be stored in the lookup table in the memory. The relationship will provide the indicator of the gas content in the formation fluid.

Furthermore, the test chamber 26 has a known volume, and the formation fluid flow can be subject to constant pressure differential across the valve 29. The resultant temperature and pressure measurements can be compared to the gas-liquid curve for the incoming formation fluid. Then, the free gas amount of the formation fluid can be determined.

If desired, this gas content determination can also be made with the test chamber 26 being held at a certain reduced pressure by opening the valved conduit 41 which connects to gas asperating (vacuum) pump included in the instrument package 28. Thus, the gas content determination can be made at constant pressure reduction across the valve 29, or if fixed orifice type expansion valving is used, by maintaining the chamber 26 at a certain reduced pressure condition. Where the formation fluid is hydrocarbons, these measurements indicate the gas-oil ratio, i.e.; whether the hydrocarbon is gas or oil, or a mixture thereof.

The instrument package 28 makes the proper temperature and pressure measurements and from them or their functions provides an indicator of the gas content in the formation fluid. The indicator can be a go—no go type of signal transmitted on cable 13. The surface operator can then transmit a downhole signal to the tool 11 so that the contents of chamber 26 are transferred into sample chamber 27. For this purpose, the control valve in pipe 42 is opened to fluid flow. If desired, this signal can be provided directly from the instrument package 28. After the sample of formation fluid is within chamber 27, the valve in pipe 42 is closed to fluid flow. The tool 11 can now be returned to the surface for analysis of the formation fluid which can be transferred into an external receiver by using the valved outlet 44 at the bottom of the tool 11. If a sample of the formation fluid is not desired, the contents of the test chamber 26 can be purged by pressurized gas released through conduit 41 with the conduits 42 and 44 open to flow.

As seen in FIG. 2, the temperature measurements across the valve 29 can be made suitable transducers, and the transducers 34 and 36 can be thermocouples formed of two different metal wires whose junctions are mounted onto the inlet pipe 31 and outlet pipe 32 adjacent the valve 29. The thermocouples (cold and hot junctions) are connected by the usual electric circuit with a temperature readout device 35. Preferably, the device 35 measures the no-current e.m.f. in the circuit, and this measurement for known metal thermocouples provides the temperature difference produced by the gas content in the fluid flowing through the valve 29.

More particularly, the valve 29 can be formed by an upstream tapered restriction 16 carried by the pipe 31 and a downstream outward flare 17 on the pipe 32, which restriction and flare provide a flow restriction or orifice 20 which resists plugging by formation particles and debris. Since a pressure-drop is produced to fluids flowing through the orifice 20, gas in these fluids is released to expand and thereby a temperature differential is produced between the transducers 34 and 36.

It is also possible to employ for temperature measurements, the fiber optic interferometer shown in FIG. 3. The interferometer includes a coherent light source 46 and may provide light beam 47. For example, the source 16 may be in gallium aluminum arsenide laser. The coherent light 47 is passed through a beam splitter 48 that can embody mirrors or prisms and the result is two equal intensity coherent light beams 49 and 51. These beams are passed through coils 52 and 53 formed of a suitable fibers (e.g. glass) that can transmit the light beams with good efficiency. The coils 52 and 53 are wound in good thermal contact about the fluid conduits 31 and 32, respectively. The coils pass the beams 49 and 51 into detector 57.

Since the coils 52 and 53 are subjected to different temperature conditions, there are refractive index and length changes between these coils.

The fibers in coils 52 and 53 need only to be the same optical path length to within the coherence length of the coherent source 46. The lowering of temperature in coil 53 relative to coil 52 will cause the light traveling through the latter coil to travel at a different velocity inversely proportional to the index of refraction change and a different distance proportional to the change in fiber length. A change in either parameter which causes the light to experience a one-half wavelength optical path change in one arm relative to the second arm will result in a change in the intensity of the interference pattern of light from the two arms 49 and 51. This change in the optical path length will result in a constructive-to-destructive cycle in a suitable detector 57 which cycle can then be counted.

Generally, the coils 52 and 53 are initially at the same temperature before the "cycle count" from the detector 57 is begun, and this may be considered the instrument "zero". After formation fluid flows through the expansion type valve, if gas is present, there is a temperature drop in the downstream pipe 32. Thus, the coil 53 is cooled which produces the above mentioned changes in its optic fiber. The detector 57 responds by reflecting the number of "cycles" detected during the cooling of the coil 53. Now, a count of these "cycles" occuring during the temperature drop in coil 53 is related to the gas content of the formation fluid.

In the present tool 11, the light signals from arms 49 and 51 optically interfere on the detector 57 which produces an output signal 58 representative of the changes in the optical path occuring per unit time. For example, the detection can be by a silicon detector element.

The signal 58 is now one input to a comparator 59 wherein a comparison is made to a reference voltage. Therefore, the comparator 59 produces as an output signal 61 an electrical representation, preferably as pulses, of the temperature induced change in the optical path length.

The pulsing signal 61 is the input to a counter 62, which signal is integrated and summed, and them accumulated as "counts" in readout 63 that can be sent by the signal bus 39 to the instrument package 28. Therein, the "counts" readout 63 is proportionate in number to the temperature difference between the inlet and outlet pipes 31 and 32, respectively. Since the "counts" readout 63 is nearly instantaneous and simultaneous to the temperature measurements, the processing of it into the temperature difference is made in real time by the microprocessor or other computer data handling systems.

From the foregoing, it will be apparent that there has been provided a novel system, including method and apparatus, for the in situ indicator of the gas content in formation fluid using thermal expansion principles. It will be appreciated that certain changes or alterations in the present system can be made without departing from the spirit of this invention. These changes are contemplated by and are within the scope of the appended claims which define the invention. Additionally, it is intended that the present description be taken as an illustration of this invention.

What is claimed is:

1. A method for the insitu measurement of gas content in formation fluid comprising:

(a) positioning a test chamber in a wellbore in proximity to a source of formation fluid;

(b) passing the formation fluid from the source through an expansion type valve into a test chamber;

(c) measuring the temperature of the formation fluid upstream and downstream of the expansion-type valve; and (d) the difference in said temperature measurements being an indicator of gas content in the formation fluid.

2. The method of claim 1 wherein the difference in said temperature measurements for a certain difference in pressure measurements of the formation fluid upstream and downstream of the expansion type valve is at least a qualitative indicator of gas content in the formation fluid.

3. The method of claim 1 wherein the difference in said temperature measurements is taken with the flow of formation fluid at a predetermined rate through the expansion type valve as at least a qualitative indicator of the gas content in the formation fluid.

4. The method of claim 1 wherein the difference in said temperature measurement is taken with the flow of formation fluid through a fixed orfice expansion-type valve into the test chamber of finite volumetric capacity as at least a qualitative indicator of the gas content in the formation fluid.

5. The method of claim 4 wherein the test chamber, the pressure magnitude therein is measured throughout the period of formation fluid inflow.

6. The method of claim 1 wherein the formation fluid is passed from the test chamber when the indicator of gas content is favorable indicating that the formation fluid contains hydrocarbons rather than only formation water.

7. A system for the insitu measurement of the gas content of formation fluid comprising:

(a) a tool adapted to be positioned downhole in a wellbore in proximity to a source of formation fluid;

(b) said tool provided with a test chamber adapted to contain a fluid in isolation to the wellbore;

(c) an expansion-type valve on said tool through which formation fluid must pass from the wellbore into said test chamber;

(d) means for measuring the pressure of the formation fluid upstream and downstream of said expansion type valve;

(e) first means for measuring the temperature of the formation fluid upstream and downstream of said expansion type valve; and (f) second means for comparing the difference in said temperature measurements to said pressure measurements; and (g) third means receiving data from said second means to provide at least an indicator qualitative readout of the gas content in the formation fluid.

8. The system of claim 7 wherein in said second means the difference in said temperature measurements is compared with the difference in said pressure measurements, and said third means provides an indicator qualitative readout of the gas content in the formation fluid.

9. The system of claim 7 wherein said tool contains a sample chamber interconnected by a control valve, and said valve is actuated to pass formation fluid from said test chamber into said sample chamber when said indicator readout is qualitative of gas content rather than water so that the sample of formation fluid is hydrocarbon.

10. The system of claim 8 wherein said tool contains a sample chamber interconnected by a control valve, and said valve is actuated to pass formation fluid from said test chamber into said sample chamber when said indicator readout is qualitative of gas content rather than water so that the sample of formation fluid is hydrocarbon.

11. The system of claim 7 wherein said first means includes:

(a) a coherent light source;

(b) a first optical fiber mounted on said tool in a position exposed to the temperature conditions of the formation fluid upstream of said expansion type valve;

(c) a second optical fiber mounted on said tool in a position exposed to the temperature conditions of the formation downstream of the said expansion type valve;

(d) a first optical path beam splitter interconnecting said light source with one end of said first and second optical fibers;

(e) detector means with an input of the first and second optical fibers for determining the optical path changes in the coherent light beams traveling said first and second optical fibers, and (f) readout means for providing an indicator of the optical path changes as the measurement of the temperature difference in the formation fluid upstream and downstream of said expansion type valve.

12. The system of claim 11 wherein said detector means includes a pair of silicon detectors providing pulses representative of the optical path changes.

13. The system of claim 12 wherein said detector pulses are summed in a comparator means whose output pulses are accumulated in counter means whereby said readout means connected to said counter means provide the measurement of the upstream and downstream formation fluid temperatures as in proportion to the number of pulses accumulated in said counter means.

14. A method for the insitu measurement of gas content in formation fluid comprising:

(a) positioning a test chamber in a wellbore in proximity to a source of formation fluid;

(b) passing the formation fluid from the source through an expansion type valve into a test chamber;

(c) measuring the difference in temperatures of the formation fluid upstream and downstream of the expansion-type valve; and (d) the difference in said temperatures being at least an indicator of gas content in the formation fluid.

15. The method of claim 14 wherein the difference in said temperatures for a certain difference in pressure of the formation fluid upstream and downstream of the expansion type valve is a qualitative indicator of gas content in the formation fluid.

16. The method of claim 14 wherein the difference in said temperatures is measured in the flow of formation fluid through the expansion type valve using an electric circuit including thermocouple means for measuring the temperatures of the formation fluid flows upstream and downstream of the expansion type valve and a temperature readout device.

17. The method of claim 15 wherein the formation fluid is hydrocarbons and the difference in temperatures being measured is at least an indicator of the gas-oil ratio of the formation fluid.

18. The method of claim 14 wherein the formation fluid is hydrocarbons and the difference in temperatures being measured is at least an indicator of whether the formation fluid is predominately gas or oil.

* * * * *